United States Patent [19]

Thomas et al.

[11] Patent Number: 4,976,172

[45] Date of Patent: Dec. 11, 1990

[54] BOTTLE OPENER WITH KEY RING

[76] Inventors: Orrett H. Thomas; Leonora Thomas, both of 115 Lenox Rd., Apt. E6, Brooklyn, N.Y. 11226

[21] Appl. No.: 363,719

[22] Filed: Jul. 27, 1989

[51] Int. Cl.[5] ..... B67B 7/44

[52] U.S. Cl. ..... 81/3.09; 81/3.4; 81/3.55; 7/151

[58] Field of Search ..... 81/3.07, 3.09, 3.4, 81/3.55; 7/151

[56] References Cited

U.S. PATENT DOCUMENTS

D. 172,571 7/1954 Ward ..... 81/3.05

FOREIGN PATENT DOCUMENTS 27609 5/1931 Australia ..... 81/3.55

9928 of 1906 United Kingdom ..... 81/3.4

*Primary Examiner*—Roscoe V. Parker

*Attorney, Agent, or Firm*—Dilworth & Barrese

[57] ABSTRACT

A bottle opener and key ring for lifting and twisting off bottle caps. It is made from a one piece solid body about 4" by 2". The design shows a hook at one end, a gear teeth type structure at the mid lower base, and a ring for holding keys at the other end. The ring, which carries the keys, is the only moveable part.

8 Claims, 1 Drawing Sheet

FIG. 1
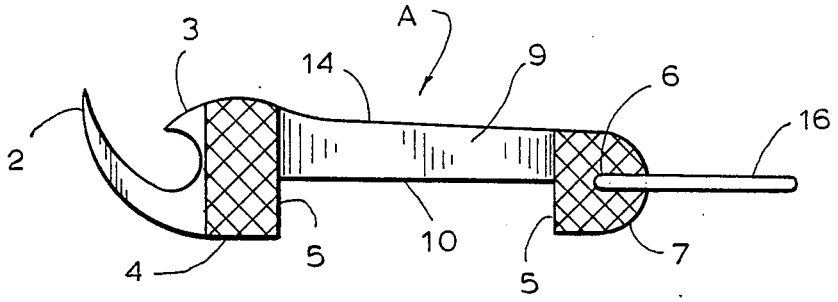
FIG. 2
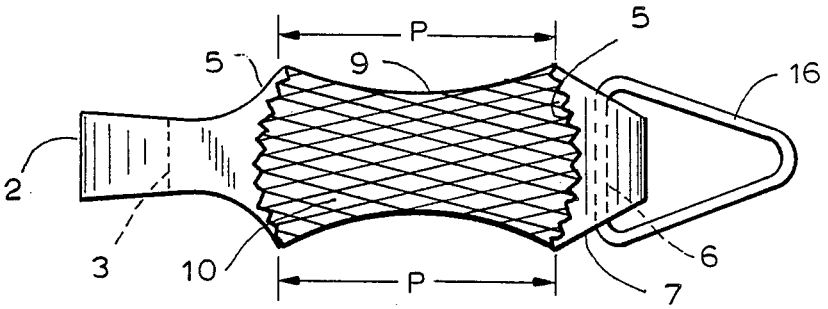
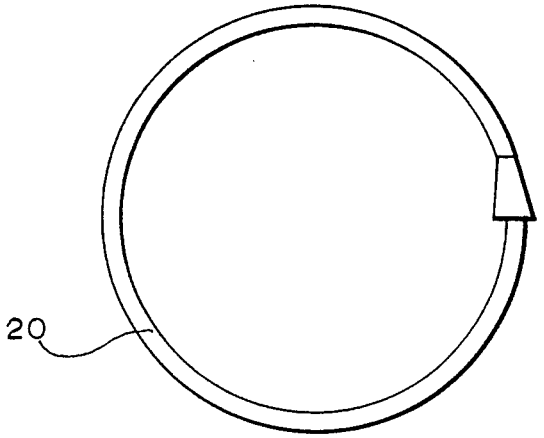
FIG. 3

BOTTLE OPENER WITH KEY RING

FIELD OF INVENTION

My invention combines two easy methods of removing bottle caps, while serving as a key ring.

SUMMARY OF THE INVENTION

My invention provides a better cap remover because:

(1) The hook end is wider and partially curved to fit the roundness of the beverage top at the lower base, the upper hook is wider to prevent slippage which helps prevent any physical harm to a person's hand.

(2) The two quandrant section type gear teeth are equally spaced at the mid lower base thereby making the opener more effective when twisting off tops without reducing the supportive strength attained with the hook end. This provides a safety measure regardless of how it is held.

(3) The gridded section as shown in the drawing on the upper, lower and the sides allows for easy twisting and lifting preventing the slippery effect of the hand.

(4) The ring end will be of two sizes. A small ring to add on any already ringed key and a large one to place any keys to the opener.

(5) The material used to construct this item are (a) Hard plastic (B) Wood (C) Cast aluminum (D) Cast iron Because of its uniqueness, it is safe to use in wet, dry or oily condition. It is guaranteed to stand up under heavy pressures. The bottle opener of the present invention is safe for travel and safe for children's lunch boxes.

BRIEF DESCRIPTION OF DRAWING

FIG. 1 is a side view of the bottle opener which shows the hook end and the gridded section on the side.

FIG. 2 is a bottom view showing the two quadrant section of the gear teeth, the lower gridded section, the key ring inserted through the hole and the "P" area.

FIG. 3 is an optional larger key ring.

DETAILED DESCRIPTION

Referring to FIGS. 1 and 2, the beverage opener designated by the letter "A" is used to lift off or twist off bottle caps, and also to carry keys. It can also be added to a key or novelty collection for immediate use. Outer hook 2 is an arcuate member extending from the first of two ends of the bottle opener A and terminating in an elongated edge. Inner hook 3 is an arcuate member extending from said first end in opposing relation to outer hook 2. Hooks 2 and 3 can extend different distances from the end of the opener. Surfaces of hand grips 4, 7, 10, and 14 are preferably gridded by cross-hatchings applied thereto by, for example, engraving or other means. The two gear teeth halves 5 provide mutually facing concave surfaces with elongated teeth extending thereon. Aperture 6 is for mounting a key ring. Hand grip 7 at the second end of the opener provides a gripping surface. Upper surface 9 is for support. Surface 10, which serves as a lower hand grip, and toothed walls 5 define a recessed area in which a bottle cap is positioned for its removal from a bottle by being twisted off. Surface 14 serves as an upper hand grip. Ring 16 is disposed through aperture 6. Areas P are two outward and oppositely facing concave side surfaces.

Hand grips 7, 4, 10 14 are gridded with diagonal lines engraved into the sections on the top, sides, and bottom of the opener body. The curved gear teeth halves 5 are positioned relative to the lower base in two quadrant sections at equal distance apart and extending inward for allowing a perfect fit and easy twist. Aperture 6 receives key ring 16, and extends through the body from side to side at the end opposite that of the hook. The key ring 16 is used for easy installation or carrying purposes. The outer hook 2 and the inner hook 3 allow the easy unhooking of beverage caps because of the unique structure of the hooks. Areas P on both sides of the hand grip 10 are oriented relative to the gear teeth walls 5 to allow for easy removal of caps which are stuck in the opener A by providing the recessed portion defined by walls 5 and surface 10 with concave side edges. The edges of a bottle cap located in the recessed portion overlap concave sides P, allowing the user to grip the cap edges to remove it from the opener. Upper support surface 9 allows for easy support when twisting caps.

FIG. 3 shows a larger key ring 20 which is optional.

We claim:

1. A bottle cap opener which comprises:

(a) first and second ends connected by a middle body portion, said middle body portion having a flat surface with two opposite concave edges delimited by outwardly facing concave sides;

(b) means at said first end for gripping and lifting a bottle cap;

(c) a recessed area delimited by a flat surface of said body portion and at least two mutually facing curved walls for gripping a bottle cap inserted therebetween, said curved walls being positioned relative to said outwardly facing concave sides of the middle body portion to facilitate removal of said bottle cap from between said curved walls.

2. The bottle cap of claim 1 wherein said means at said first end for gripping and lifting a bottle cap comprises two opposing arcuate hooks extending from said first end.

3. The bottle cap opener of claim 2 wherein at least one of said hooks terminates in an elongated edge.

4. The bottle cap opener of claim 2 wherein one of said hooks extends a greater distance than the other.

5. The bottle cap opener of claim 2 wherein said means for gripping a bottle cap comprise a series of elongated teeth extending along a concave surface portion of said curved walls.

6. The bottle cap opener of claim 1 wherein said second end has an aperture for retaining a ring member.

7. The bottle cap opener of claim 6 further including a key ring retained in said aperture.

8. The bottle cap opener of claim 1 wherein cross-hatching is engraved on at least one outer surface portion of said body member.

* * * * *